US009498795B2

(12) United States Patent
Svec

(10) Patent No.: US 9,498,795 B2
(45) Date of Patent: Nov. 22, 2016

(54) METHOD AND APPARATUS FOR SHARP COLOR DEFINITION ON THE APPLICATION OF GRANULES TO ROOFING SUBSTRATES

(71) Applicant: Building Materials Investment Corporation, Dallas, TX (US)

(72) Inventor: James A. Svec, Kearny, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/478,426

(22) Filed: Sep. 5, 2014

(65) Prior Publication Data

US 2015/0072073 A1 Mar. 12, 2015

Related U.S. Application Data

(60) Provisional application No. 61/876,388, filed on Sep. 11, 2013.

(51) Int. Cl.

| | |
|---|---|
| ***B05D 5/02*** | (2006.01) |
| ***B05D 5/06*** | (2006.01) |
| ***E04D 1/20*** | (2006.01) |
| ***B05C 19/04*** | (2006.01) |
| ***B05C 19/06*** | (2006.01) |
| *E04D 1/00* | (2006.01) |
| *B05D 1/30* | (2006.01) |

(52) U.S. Cl.

CPC ..... *B05D 5/06* (2013.01); *B05C 19/04* (2013.01); *B05C 19/06* (2013.01); *E04D 1/20* (2013.01); *B05D 1/30* (2013.01); *B05D 5/02* (2013.01); *E04D 2001/005* (2013.01)

(58) Field of Classification Search

CPC ..... B05C 19/04; B05C 19/06; B05D 1/30; B05D 5/02; B05D 5/06

USPC ..... 427/188

See application file for complete search history.

(56) References Cited

U.S. PATENT DOCUMENTS

| | | | | |
|---|---|---|---|---|
| 1,777,884 A | | 10/1930 | Horix | |
| 2,074,131 A | * | 3/1937 | Penley et al. | 427/188 |
| 3,730,397 A | * | 5/1973 | Magnus | 222/254 |
| 4,266,695 A | | 5/1981 | Ruperez | |
| 4,284,030 A | | 8/1981 | Hamilton | |
| 4,994,053 A | | 2/1991 | Lang | |

(Continued)

OTHER PUBLICATIONS

Office Action dated Jun. 4, 2014 in U.S. Appl. No. 13/584,094.

*Primary Examiner* — Alexander Weddle

(74) *Attorney, Agent, or Firm* — Womble Carlyle Sandridge & Rice LLP

(57) ABSTRACT

A high speed granule delivery system and method for dispensing granules in intermittent patterns onto a moving asphalt coated substrate includes a granule hopper and a rotationally indexable pocket wheel in the bottom of the hopper. A series of pockets are formed in the circumference of the wheel and separated by raised lands. A seal on the bottom of the hopper seals against the raised lands as the pockets are filled with granules during rotation of the pocket wheel through the hopper. As each pocket is indexed beyond the seal, it is exposed to the moving asphalt coated substrate below and its granules fall onto the substrate to be embedded in the hot tacky asphalt. The speed at which the wheel is indexed is coordinated with the speed of the asphalt coated substrate to form well defined patterns of granules at high production rates.

16 Claims, 4 Drawing Sheets

(56) References Cited

U.S. PATENT DOCUMENTS

| | | | | |
|---|---|---|---|---|
| 5,181,629 | A | 1/1993 | Camm et al. | |
| 5,405,647 | A * | 4/1995 | Grubka et al. | 427/188 |
| 5,547,707 | A | 8/1996 | Haubert et al. | |
| 5,599,581 | A | 2/1997 | Burton et al. | |
| 5,624,522 | A | 4/1997 | Belt et al. | |
| 5,634,620 | A | 6/1997 | Verot | |
| 5,795,389 | A | 8/1998 | Koschitzky | |
| 5,814,369 | A | 9/1998 | Bockh et al. | |
| 5,858,095 | A | 1/1999 | White et al. | |
| 5,944,233 | A | 8/1999 | Bourne | |
| 5,997,644 | A * | 12/1999 | Zickell | B05D 5/06 118/308 |
| 6,106,189 | A | 8/2000 | Seale | |
| 6,407,713 | B1 | 6/2002 | Mallenius | |
| 6,440,216 | B1 | 8/2002 | Aschenbeck | |
| 6,511,704 | B1 | 1/2003 | Zickell | |
| 6,582,760 | B2 | 6/2003 | Aschenbeck | |
| 6,588,637 | B2 | 7/2003 | Gates et al. | |
| 6,635,140 | B2 | 10/2003 | Phillips et al. | |
| 7,458,620 | B2 | 12/2008 | Rotole et al. | |
| 7,874,533 | B1 | 1/2011 | Gates et al. | |
| 2003/0044525 | A1 | 3/2003 | Aschenbeck | |
| 2003/0126831 | A1 | 7/2003 | Altvater et al. | |
| 2003/0168484 | A1 | 9/2003 | Gates et al. | |
| 2006/0024433 | A1 | 2/2006 | Blessing et al. | |
| 2007/0082126 | A1 | 4/2007 | Aschenbeck | |
| 2007/0284012 | A1 * | 12/2007 | Smith | A24D 3/0225 141/1 |
| 2008/0095573 | A1 | 4/2008 | Hewett et al. | |
| 2010/0038505 | A1 | 2/2010 | Sonnenberg | |
| 2010/0266811 | A1 * | 10/2010 | Kalkanoglu et al. | 428/143 |
| 2011/0130732 | A1 | 6/2011 | Jackels et al. | |
| 2011/0200747 | A1 | 8/2011 | Kida et al. | |
| 2001/0229636 | | 9/2011 | Aschenbeck et al. | |
| 2011/0315829 | A1 | 12/2011 | Darnell | |
| 2012/0058213 | A1 | 3/2012 | Lindee et al. | |
| 2012/0267408 | A1 | 10/2012 | DeVolder | |
| 2013/0207379 | A1 | 8/2013 | Meissner et al. | |

* cited by examiner 102
101
103
104
106
107
111
112
113
116
117
118
B
L
D

METHOD AND APPARATUS FOR SHARP COLOR DEFINITION ON THE APPLICATION OF GRANULES TO ROOFING SUBSTRATES

REFERENCE TO RELATED APPLICATION

Priority is hereby claimed to the filing date of U.S. provisional patent application No. 61/876,388 entitled Method and Apparatus for Sharp Color Definition on the Application of Granules to Roofing Substrates, which was filed on Sep. 11, 2013.

TECHNICAL FIELD

This disclosure relates generally to asphalt shingle manufacturing and more particularly to systems and methods of applying granules to a rapidly moving substrate of material coated with sticky asphalt.

BACKGROUND

Asphalt-based roofing materials, such as roofing shingles, roll roofing, and commercial roofing, have long been installed on the roofs of buildings to provide protection from the elements and to give the roof an aesthetically pleasing look. Typically, asphalt-based roofing material is constructed of a substrate such as a glass fiber mat or an organic felt mat, an asphalt coating on the substrate to provide a water barrier, and a surface layer of granules embedded in the asphalt coating. The granules protect the asphalt from deterioration due to exposure to UV and IR radiation from the sun and due to direct exposure to the elements.

A common method of manufacturing asphalt-based shingles is to advance a web of material through a coater, which coats the web with liquid asphalt forming a hot tacky asphalt coated substrate. The asphalt coated substrate typically is then passed beneath one or more granule dispensers, which discharge or dispense protective and decorative surface granules onto at least selected portions of the moving asphalt coated substrate. A granule dispenser may be as simple as a direct feed nozzle fed by an open hopper that is filled with granules or as complex as a granule blender. The result is an elongated substrate of shingle stock, which can later be sliced and cut to size to form individual shingles, cut and rolled to form a rolled shingle, or otherwise processed into final products.

In some shingle manufacturing processes, there is a need to deliver granules at intermittently timed intervals such that granules are deposited on the asphalt coated substrate in spaced generally rectangular patches. In such cases, several mechanisms have been used in the past to start and stop the delivery of granules in a controlled manner to drop granules intermittently. For example, a fluted roll and gate assembly has been installed at the bottom of a granule dispenser nozzle. Rotation of the fluted roll through a predetermined angle pulls a charge of granules from a granule hopper and drops the granules a set distance (generally 12 inches or more) onto the asphalt coated substrate below. In some cases, the charge of granules slides down a polished curved surface toward the substrate material. The curved surface in conjunction with gravity may accelerate the charge of granules to approximately the speed of or slightly greater than the speed of the moving asphalt coated substrate below. In this way, the charge of granules is deposited more gently onto the asphalt, to which the granules stick to form the protective decorative coating.

Prior systems and methods for depositing granules onto an asphalt coated substrate in shingle manufacturing have exhibited a variety of inherent problems. Chief among these is that as the speed of production increases, meaning that the speed of the moving asphalt coated substrate increases, the edges and patterns of dispensed charges of granules on the asphalt become less and less defined. Eventually, the deposited patterns of granules are so indistinct and distorted as to be unacceptable in appearance, coverage, and protection. Trailing edges in particular of a deposited charge of granules become more and more smeared out as the speed of production is increased and dispensed charges of granules exhibit unacceptable trailing patterns. As a result, granule delivery systems and methods in the past have been practically limited to production speeds below about 800 feet per minute (fpm) of asphalt coated substrate travel, also referred to as machine speed or line speed. This can be a bottle neck since other areas of production such as asphalt application are capable of moving much faster.

Modern asphalt roofing shingles may have granules of several colors arranged in spaced patches to provide a pleasing aesthetic and the appearance of texture when the shingles are installed. A common example is patches of three colors; a blend or background color, a dark color, and a light color. These patches may be arranged in any of a number of sequences such as, for instance, blend-dark-blend-light-blend-dark-blend-light and so on. When manufacturing such shingles, it is necessary that the lines of demarcation between the different color patches be sharp and well defined. Otherwise, the shingles will not have a commercially acceptable appearance. However, at higher line speeds above about 800 FPM, it becomes difficult with traditional granule application techniques to maintain well defined lines of demarcation because, among other things, of the indistinct trailing edges of granule drops mentioned above.

There is a need for a granule delivery system and method for use in shingle manufacturing that is capable of delivering a charge of granules at intermittently timed intervals onto a moving asphalt coated substrate with precision, definition, and controllability and at manufacturing or line speeds of over 800 FPM and even over 1000 FPM. There is a further need for a method of depositing patches of different color granules with well defined lines of demarcation between adjacent patches at high line speeds. It is to the provision of such an apparatus and method that the present invention is primarily directed.

SUMMARY

Briefly described, a granule delivery system and method are disclosed for dispensing charges of granules intermittently onto a moving asphalt coated substrate as the substrate is moved in a downstream direction below. In one embodiment, the delivery system includes a hopper for containing a supply or store of granules. A generally cylindrical pocket wheel is mounted at the bottom portion of the hopper with the upper portion of the wheel exposed to granules in the hopper and the lower portion of the wheel exposed to the moving asphalt coated substrate below. The outer surface of the rotor is formed with a series of pockets separated by upstanding or raised lands. In one embodiment, a total of six pockets are formed around the periphery of the pocket wheel, although more or fewer than six pockets are possible. A brush seal may be located at the bottom of the hopper and includes brushes or other sealing members positioned to ride on the lands of the pocket wheel as the lands are rotated past the brush seal. The brush seal also rides across the open pockets as the pockets rotate out of the hopper to level a charge of granules collected by the pockets and thereby insure that a substantially consistent volume of granules is contained by each pocket.

The pocket wheel is driven through a gear train by a servo motor that is controlled by a computer, controller, or an indexer to index the pocket wheel at a controlled speed and through a prescribed rotational angle. More specifically, the pocket wheel is rotated from one position where the brush seal seals against one land to a successive position where the brush seal seals against the next successive land. In the process, the pocket defined between the two lands rotates downwardly and is progressively exposed in an inverted orientation above the moving asphalt coated substrate below.

In operation, the hopper is filled with granules, an asphalt coated substrate is moved below the dispenser at a line speed, and the pocket wheel is repeatedly indexed as described. As the pocket wheel rotates in indexed increments, the pockets around the circumference of the wheel move through the granules in the hopper as the pockets traverse the upper portion of the wheel. The pockets are filled with granules as they drive through the store of granules. As each pocket is indexed past the brush seal, the seal rides across the open pocket to level the granules within the pocket, which immediately begin to drop out of the now inverted and rotating pocket toward the moving asphalt coated substrate below. The granules thus are deposited on the asphalt in a pattern that substantially corresponds with the shape of the pocket.

The surface speed at which the pocket wheel is indexed is coordinated with the production speed of the asphalt coated substrate below. In one embodiment, the surface speed can be approximately the same as the production speed. In such an embodiment, the charge of granules is moving in the production direction at about the same speed as the asphalt coated substrate when the granules fall onto the substrate. In another embodiment, the surface speed at which the pocket wheel is indexed can be different from the production speed. For example, the surface speed might be coordinated to be one-third the production speed. As a result, a pattern approximately three times the circumferential length of each pocket is deposited on the asphalt coated substrate below. Other ratios are possible. In any event, a well defined patch of granules is deposited and subsequent operation of the system forms additional patches of deposited granules along the length of the asphalt coated substrate. The system and method of this invention is capable of depositing a charge of granules in a patch that is characterized by very good uniformity, well defined edges, and little distortion. This is particularly true for the leading edges of the patch, even at high line speeds. Furthermore, these characteristics are expected to be preserved at production speeds substantially higher than those obtainable with prior art granule blenders and other granule dispensing devices, particularly when ratioed indexing is employed.

In another aspect of the invention, a method of applying granules to a moving asphalt coated substrate in adjacent patches of different colored granules is disclosed. The method makes use of the apparatus of the invention and results in sharp and well defined boarders between the different color patches even at speeds where indistinct trailing edges of patches may be present. Thus, even higher line speeds may be accommodated when producing shingle stock with adjacent patches of different colored granules.

Accordingly, a system and method of delivering charges of granules onto a moving asphalt coated substrate in shingle production is disclosed that addresses successfully the problems and shortcomings of existing granule dispensing technology and is capable of depositing highly defined patterns of granules at production speeds exceeding the capability of existing equipment. A method of depositing granules with the apparatus to create sharp demarcations between different color granules at high line speeds between also is disclosed. These and other aspects, features, and advantages of the invention will be better appreciated upon review of the detailed description set forth below, when taken in conjunction with the accompanying drawing figures, which are briefly described as follows.

DETAILED DESCRIPTION

Figure 1:
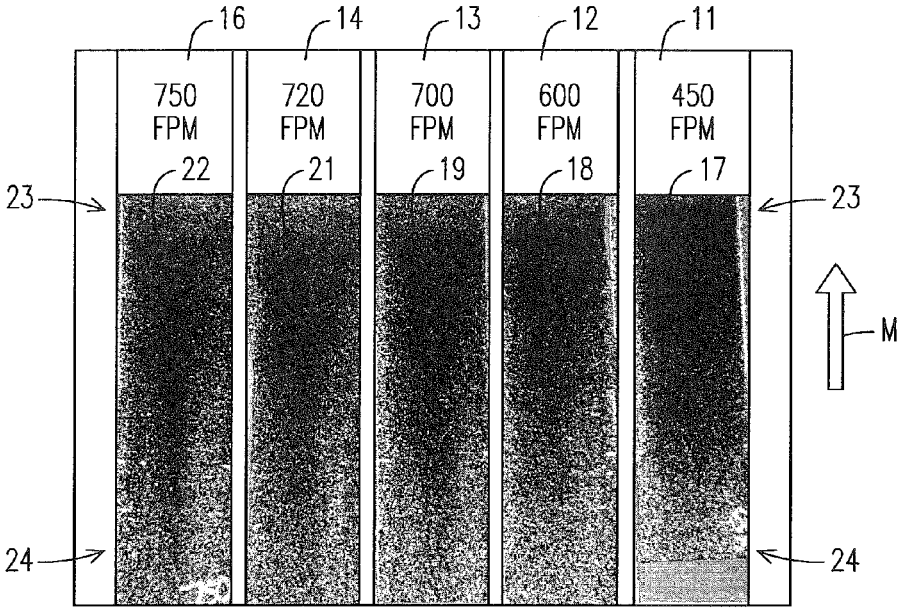
FIG. 1 PRIOR ART
FIG. 1 shows granule patterns on substrates of material resulting from a traditional prior art granule delivery system run at various increasing production speeds.

Reference will now be made in more detail to the drawing figures, wherein like reference numerals, where appropriate, indicate like parts throughout the several views. FIG. 1 illustrates the production speed limitations of a traditional prior art granule delivery system This figure may, for instance, represent results from a fluted roll type granule dispenser as discussed above. Five test substrates of material 11, 12, 13, 14, and 16 were advanced along a shingle production line at five different line speeds. As illustrated, substrate 11 was advanced at 450 FPM, substrate 12 at 600 FPM, substrate 13 at 700 FPM, substrate 14 at 720 FPM, and substrate 16 was advanced at 750 FPM. As each substrate moved beneath the granule dispenser, the dispenser dropped granules onto the moving substrate in the traditional prior art manner. In FIG. 1, the machine direction in which the substrates of material moved is indicated by arrow M. In each case, a pattern of granules 17, 18, 19, 21, and 22 was deposited onto the respective test substrate of material by the granule dispenser. The leading edges of each granule pattern are at the top of FIG. 1 and indicated by numeral 23. Trailing edges are near the bottom of FIG. 1 and are indicated by numeral 24.

As can be seen from FIG. 1, at a line speed of 450 FPM, which is a common production speed in the industry, a reasonably tight and well defined patch of granules is deposited onto the substrate 11. There is some trailing edge patterning, but within acceptable limits. This pattern is acceptable and common for commercial shingle production. As the production speed is increased, the pattern of granules deposited by the prior art granule dispenser system becomes more and more degraded. At 600 FPM, for instance, the pattern appears a bit more indistinct, the trailing edge 24 is thinned and spread more in the non-machine direction, and the leading edge 23 is less distinct. The same phenomenon continues with increasing line speeds until at 750 FPM production speed, the deposited granules are unacceptably patterned throughout, and the leading and trailing edges of the pattern are unacceptably indistinct. It will thus be seen that traditional prior art granule delivery systems limit the practical line speed of a shingle manufacturing operation to somewhat less than 750 FPM.

Figure 2:
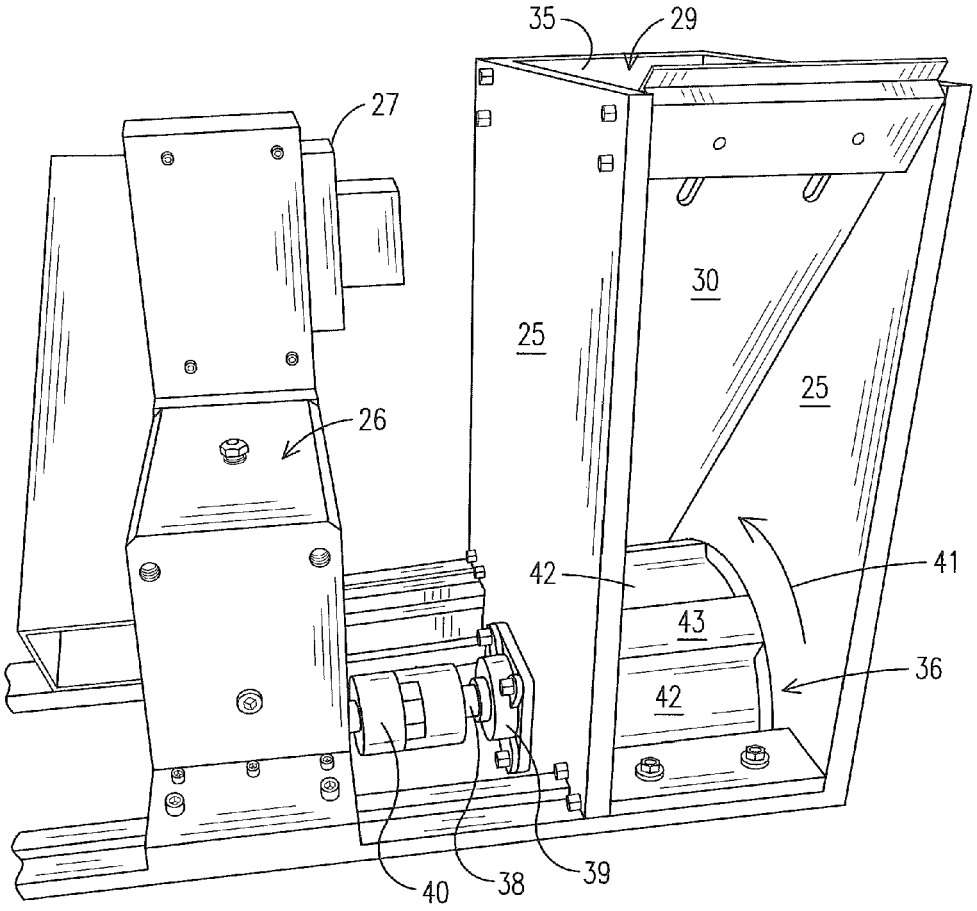
FIG. 2 is a perspective view of a prototype apparatus that embodies principles of the system.

FIG. 2 shows a granule delivery apparatus that was built to test the methodology of the present invention. The apparatus comprises a housing at least partially defined by side walls 25. A hopper wall 30 is mounted between the side walls 25 and extends downwardly at an angle toward the bottom rear portion of the housing. A rear wall 35 closes the back side of the housing and together with the angled hopper wall 30 defines an open top hopper 29 for receiving and holding a store of granules to be dispensed by the apparatus. A pocket wheel 36 is mounted in the bottom portion of the housing via a shaft 38 journaled in bearings 39 such that the pocket wheel is rotatable in the direction of arrow 41. The shaft 38 is coupled through coupler 40 to an indexing drive mechanism including indexer 26, which, in turn, is driven by a servo motor through a gear box 27.

The pocket wheel 36 in this embodiment is generally cylindrical in shape and its peripheral surface is formed with a series of radially depressed pockets 42 separated by raised lands 43. In the embodiment shown in FIG. 2, a total of six pockets 42 are formed around the periphery of the pocket wheel 36; however, more or fewer than six pockets are possible within the scope of the invention. Further, the pockets of the prototype are generally rectangular, but they may have other configurations for depositing granule charges in different patters as described in more detail below. In operation, the drive mechanism is controlled by the indexer in this case to cause the pocket wheel 36 to rotate in direction 41 in incremental steps of one-sixth of a circle, or 60 degrees. In other words, the pocket wheel is incremented through 60 degrees and then stops for a predetermined time before being incremented again through 60 degrees and so on. The time between incremental rotations as well as the speed of rotation during incremental rotations can be controlled to correspond to a given line speed.

Figure 3:
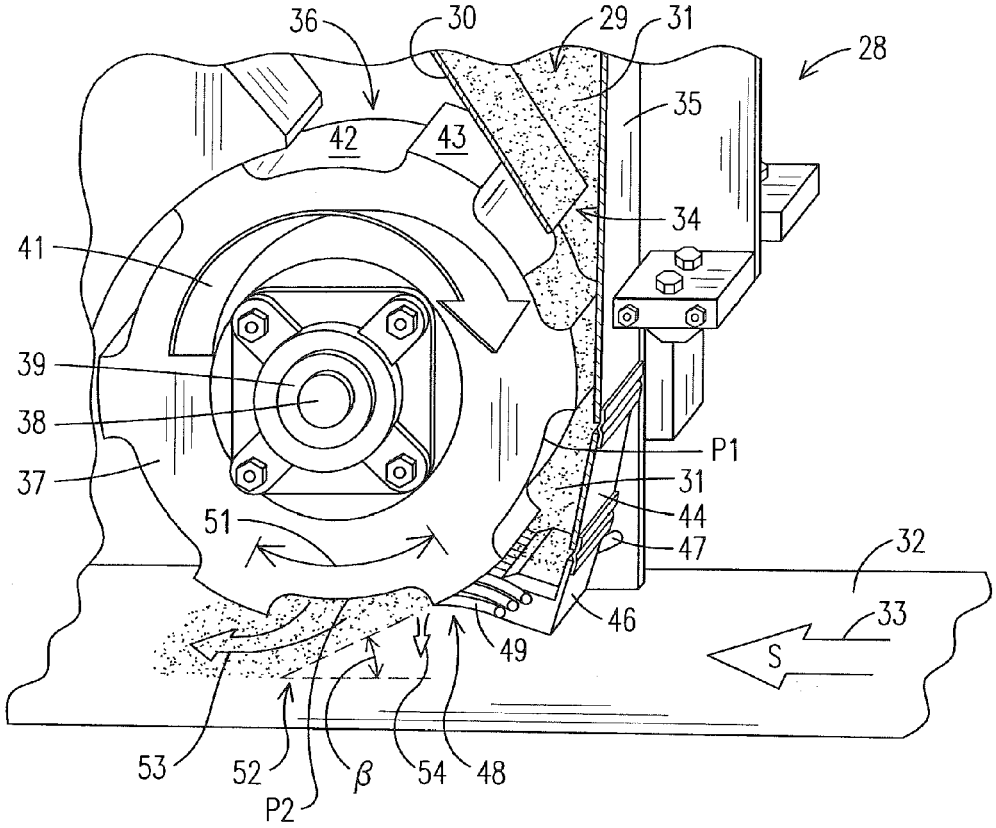
FIG. 3 is a partially sectioned perspective view of a system that embodies principles of the present invention and showing operation of the system to deliver granules to a asphalt coated substrate.

FIG. 3 illustrates in more detail the high speed granule delivery system 28 for depositing a charge of granules onto a moving asphalt coated substrate 32. The system 28 comprises a granule hopper 29 (only the lower portion of which is visible in FIG. 2) having a nozzle or mouth 34. The mouth 34 of the hopper is generally defined by the wall 35 on the right and the angled hopper wall 30 on the left so that granules 31 in the hopper are constrained to flow downwardly to the relatively narrow mouth 34 of the hopper 29 under the influence of gravity.

The pocket wheel 36 is rotatably mounted at the bottom of the hopper adjacent the mouth 34. The pocket wheel 36 in the illustrated embodiment is formed with a hub 37 that is mounted on an axle 38, which, in turn, is journaled for rotation within a bearing assembly 39. The bearing assembly 39 is mounted to a side wall 25 (FIG. 2) of the system, which is not visible in the partial cross sectional view of FIG. 2. In operation, as described in more detailed below, the pocket wheel 36 is rotated in direction 41 in indexed increments by the drive mechanism.

The pocket wheel 36 is generally cylindrical in shape except that its peripheral portion is formed or otherwise configured in this embodiment to define a series of radially depressed pockets 42 separated by raised lands 43. There are a total of six pockets in the embodiment of FIG. 3, but it will be understood by the skilled artisan that this is not a limitation of the invention and that more or fewer than six pockets may be provided. In any event, the pockets are sized such that they define a volume between opposing lands and the sides of the pockets that is substantially equal to the desired volume of a single charge or drop of granules to be deposited onto the moving asphalt coated substrate 32 below.

A baffle 44 extends downwardly from the wall 35 of the hopper to a lower end and a seal mount fixture 46 is attached to the lower end of the wall 35 and extends downwardly therefrom. Secured within the seal mount fixture 46 is an elongated seal 48 that is held by the seal mount fixture at a position such that the seal 48 engages against the raised lands 43 of the pocket wheel 36 as the lands move past the seal 48. Similarly, the seal 48 rides across the open pockets of the pocket wheel as the pockets rotate past the seal. In the illustrated embodiment, the seal 48 comprises a set of brushes 49 fixed within the seal mount fixture 46 and extending to engage the passing lands, thereby forming a brush seal. It is not necessary that the seal between the seal 48 and the raised lands be water tight. It is only necessary that the seal 48 seal substantially against migration of granules past the seal as the pocket wheel rotates. The brush seal created by the set of brushes 49 has proven adequate to meet this need. Further, the brush seal shown in this embodiment have proven to function well for leveling a charge of granules in the pockets as the pockets rotate past the seal.

Although brush seals are shown and described above, seals other than brush seals, such as, for instance, rubber fins, a solid gate, a movable gate, a rotary gate, or any other mechanism that prevents unwanted granules from migrating past the periphery of the pocket wheel may be substituted for the illustrated brush seals. Any and all sealing mechanisms should be construed to be equivalent to the illustrated brush seals in FIG. 2. Further, the location or position of the seal around the periphery of the pocket wheel also may be adjusted by an adjustment slot 47 or other appropriate mechanism to change the angle of attack and other characteristics of granules dispensed during operation of the system, as described in more detail below.

Operation of the system 28 to perform the method of the invention will now be described in more detail with continuing reference to FIG. 3. The system 28 is mounted along a shingle fabrication line just above a conveyor, along which a substrate 32 of substrate material coated with hot liquid asphalt is conveyed in a downstream or machine direction 33 at a line speed of S fpm. The hopper 29 of the system is filled with granules 31 to be dispensed intermittently onto the surface of the substrate 32 in substantially rectangular patterns as the substrate 32 moves past and below the granule delivery system 28. As the sticky asphalt coated substrate 32 moves past the granule delivery system, the drive mechanism rotates the pocket wheel through an increment of rotation and then stops before rotating the wheel through a next successive increment of rotation.

In the illustrated embodiment of FIG. 3, the increment of rotation, indicated by arrow 51, is one-sixth of a full circle since the pocket wheel 36 of this particular embodiment has six pockets. Further an increment begins with the seal 48 engaging and sealing against the top of one of the lands that separate the pockets and ends with the seal 48 engaging and sealing against the top of the next successive land. Preferably, any acceleration or deceleration of the pocket wheel occurs while the seal is still riding on the land such that the pockets are moving at their full linear speed when they begin to be exposed beyond the seal. In the process, the pocket 42 between the two lands progressively rotates beyond the seal 48 and is exposed to the moving asphalt coated substrate below.

With continued reference to FIG. 3, and with the forgoing description in mind, it will be seen that when the pocket wheel is rotated, each pocket drives through the store of granules 31 within the lower portion of the hopper below the mouth 34 just before encountering and moving beyond the seal 48. This fills the volume of the pocket with granules. As the pocket begins to rotate beyond the seal 48, the seal rides across the open pocket to level off the granule charge in the pocket at about the location of the tops of the lands so that the volume of the granule charge is about the same as the volume of the pocket.

As soon as the pocket begins to move past the seal 48, the granules in the pocket begin to fall toward the moving substrate below under the influence of gravity, as indicated generally by arrow 48. At the same time, the granules leave the pocket with a forward speed imparted to them by the rotational momentum of the pocket wheel in direction 51. The downward and forward motion causes the charge of granules to approach the moving asphalt coated substrate 32 at an angle β, which is referred to herein as the angle of attack or angular discharge of the granule charge. The angular discharge of the granule charge can be varied according to need through adjustment of the circumferential location where the seal 48 engages the lands 43 of the pocket wheel. The stop position of the pocket wheel between intermittent rotations also can be adjusted to affect the angular discharge of the charge of granules as needed.

In one embodiment it may be desired that the forward speed of the granules as the charge of granules leaves the pocket be approximately the same as the line speed S of the asphalt coated substrate below to deposit a highly defined crisp pattern of granules. This forward speed is established by the rate at which the pocket wheel is rotated by the drive mechanism and can be varied to match a particular line speed by varying this rate of rotation. In this way, the granules fall in this embodiment straight down into the sticky asphalt from the perspective of the moving substrate so that they are less likely to bounce or otherwise be scattered when they hit the surface of the substrate. Such scattering is further reduced since the granules can be released with the present invention, unlike prior art devices, very close to the surface of the substrate. The granules therefore have less momentum to dissipate when they strike the asphalt and are less likely to bounce and otherwise scatter. The ultimate result is that the charge of granules are deposited on the asphalt in a sharply defined grouping or patch with crisp edges and very little if any patterning across the width of the grouping.

In another embodiment, it may be desired that the forward speed of the granules as they leave the pocket, and thus the rotational speed of the pocket wheel, be greater than or less than the line speed S. As one example, the rotational rate of the pocket wheel may be controlled so that it is, say, one-third of the line speed S such that the speed of the asphalt coated substrate below is three times the forward speed of the granules when the granules fall onto the substrate. The result is a deposit of granules onto the asphalt coated substrate that is approximately three times the circumferential length of a pocket of the pocket wheel. Although some granule scattering may occur under these conditions, it is expected to be within acceptable limits so that an acceptably well defined deposit of granules is maintained.

Using such a ratioed indexing methodology, higher production speeds can be accommodated easily with the present invention. For instance, a production speed of 1500 FPM, far higher than the current norm, should be able to be accommodated with acceptable results with the linear speed of the pocket wheel set to 500 FPM. Of course, the depth of the pockets are predetermined or adjusted with an insert or the like such that the appropriate volume of granules for the desired pattern and thickness of the deposited granules is delivered with each indexed rotation of the pocket wheel, accounting for the fact that the granules are deposited in a more spread out pattern on the moving substrate. It will be appreciated by the skilled artisan that ratios other than three to one are possible according to production specific requirements.

EXAMPLE

Figure 4:
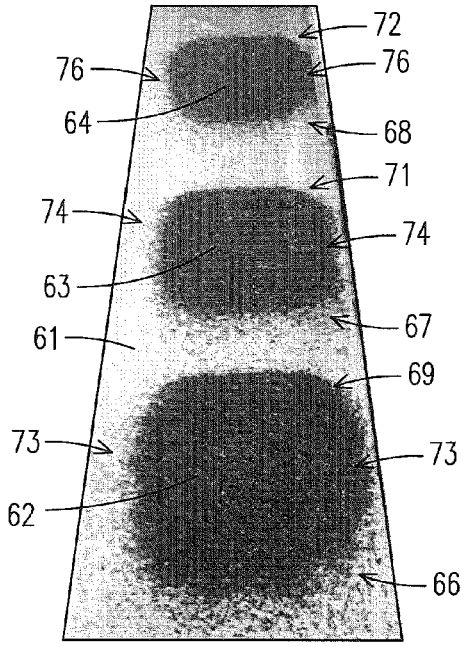
FIG. 4 shows granule patterns on a substrate of material resulting from use of the system of this invention to deliver granules on the substrate.

A prototype of the apparatus of the present invention was constructed for testing the methodology of the invention to deposit granules at higher line speeds. A substrate of cardboard was obtained to mimic an asphalt coated substrate and the substrate was placed beneath the prototype system, which was filled with granules. The pocket wheel was then indexed as described above to deposit a charge of granules onto the cardboard. In this example, the linear speed of rotation at the pockets of the pocket wheel was about 50 fpm and for this test, the cardboard substrate was stationary. The test was repeated three times at different locations on the cardboard substrate and results are illustrated in the photograph of FIG. 4. In this photograph, the three deposits of granules 62, 63, and 64 are shown with respective leading edges 66, 67, and 68; respective trailing edges 69, 71, and 72; and side edges 74. It can be seen that the trailing edges 69, 71, and 72 are sharp and well defined and also that the side edges (less important in reality) also are well defined.

In this example, the forward throw of granules at the leading edges 66, 67, and 68 is clearly visible, but it is believed that this is due to the fact that the cardboard substrate of the experiment was stationary and not moving. Thus, the forward momentum of the granules relative to the stationary substrate of cardboard tended to throw them forward on the substrate. When operating on a production line, the linear speed of the production line likely will be approximately the same as or faster by a selected ratio than the linear speed of rotation of the pocket wheel. Thus, the granules will fall either straight down onto the asphalt coating from the perspective of the moving substrate or will tend to be scattered backward into the deposited pattern rather than forward on the asphalt coated substrate. This should result in a clear well defined pattern (rectangular in this example) without tailings due to acceleration and deceleration profiles. The desired placement of the granules onto the asphalt of the moving substrate can be accomplished largely by appropriate programming of the drive mechanism. As a result, it is believed that crisply patterned deposits of granules can be placed onto a moving asphalt coated substrate at production speeds heretofore not achievable.

FIGS. 5*a*-5*e* will be referred to in describing a sequencing pattern of granule deposits on a moving asphalt coated substrate that results in sharp linear color definition between granules patches of different colors. As mentioned above, the apparatus of the invention can produce a granule patch with a sharp leading edge at very high line speeds. However, trailing edges of granule patches can start to become scattered as speeds increase. The method provides sharp linear color definition even when there is some trailing edge spreading of each individual patch of granules of the various colors. In the example of these figures, it is desired to create shingle stock with a repeating pattern of granule patches of different colors. The pattern here is blend (B)—light (L)—blend (B)—dark (D) and so on. It is further required that each patch of colored (or blended) granules have distinct leading and trailing edges so that there is a sharp linear color definition between adjacent granule patches along the length of the shingle stock.

The method may be carried out using three granule dispensers of the type described above arranged along the production line so that high line speeds can be accommodated. The upstream granule dispenser is programmed to dispense a blend of light and dark colored granules, the next is programmed to dispense light colored granules, and the downstream granule dispenser is programmed to dispense dark colored granules. Further downstream of the three granule dispensers is a dispenser that dispenses a blend of granules in a continuous pour or curtain onto the substrate.

Figures 5A, 5B, 5C, 5D, 5E:
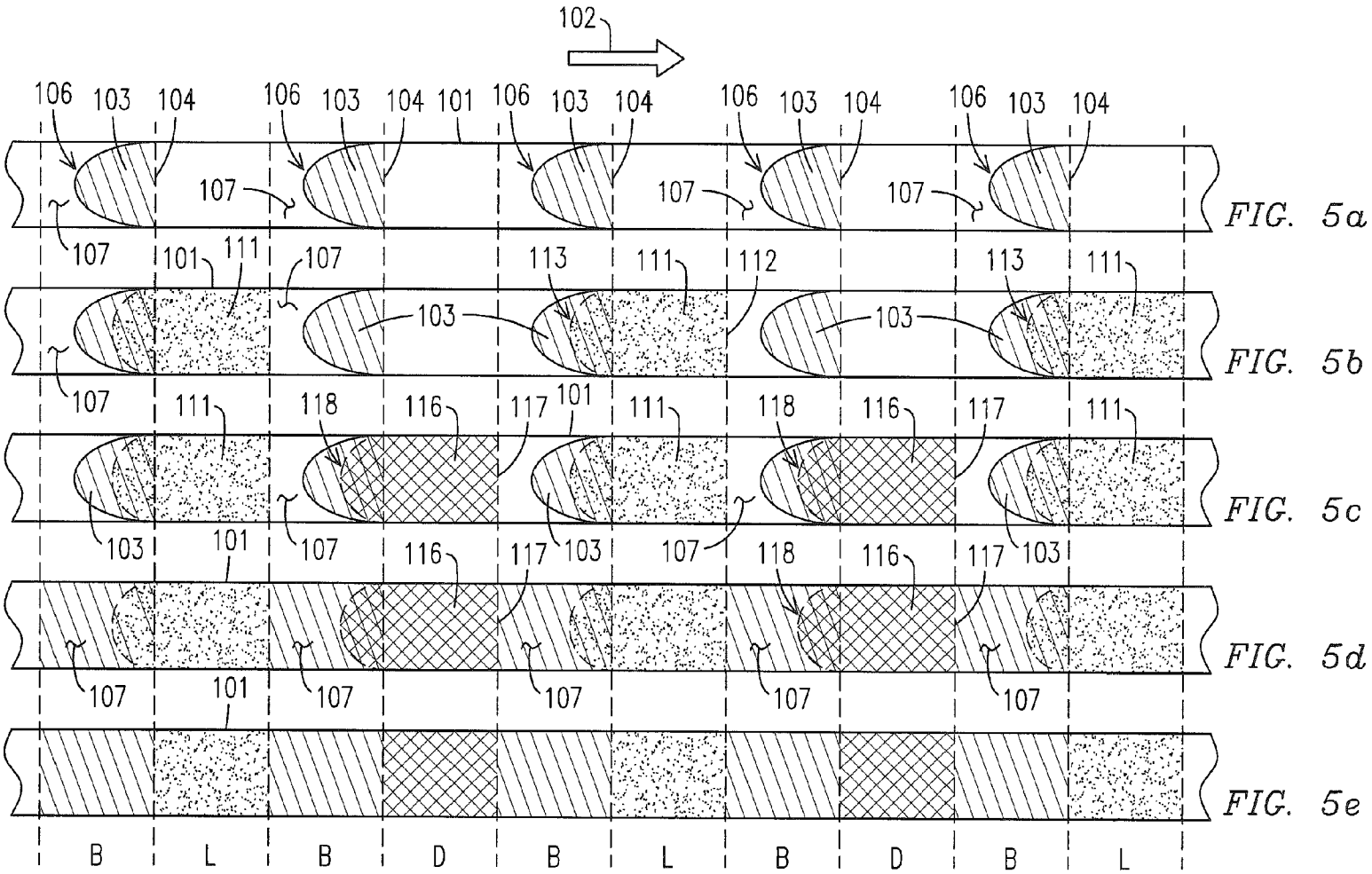
FIGS. 5*a*-5*e* illustrate sequentially a method according to the invention for fabricating asphalt shingles with sharp linear color definition separating areas of different color granule patches on the shingles.

FIG. 5*a* illustrates the blend granule patterns dispensed by the upstream granule dispenser in areas of the moving asphalt coated substrate designated to receive a blend of light and dark granules. These areas are designated with a B for "Blend" in the figures and will be referred to for clarity as "blend areas." As the leading edge of a blend area passes beneath the upstream granule dispenser, the dispenser is triggered to drop only a partial charge of blended granules onto the moving asphalt coated substrate. Each of these partial drops results in a pattern of granules 103 that only partially fills a blend area. At high line speeds, the resulting patch is likely to have a sharp leading edge 104 and may have a less distinct and more scattered trailing edge 106. An uncovered and exposed portion of the blend area B remains immediately behind the deposited pattern of granules 103.

FIG. 5*b* illustrates the next drop of granules by the next granule dispenser, in this case a drop of light colored granules in the designated light areas L just upstream of each of the previously applied blend granule patterns. As the leading edge of each designated light area moves past the next granule dispenser, the dispenser is commanded to begin a full drop of light colored granules into the light area. The result is a patch of light colored granules having a sharp leading edge 112, a field that fills the light area L, and a scattered or indistinct trailing edge 113. However, the granules that fall into the trailing edges 113 overlap the leading edges of adjacent blend areas B, which already have been covered with blend granules. Accordingly, the light colored granules in the indistinct trailing edges of the light granule patches do not stick to the moving substrate 101. They just lay loosely on top of the previously deposited granules.

FIG. 5*c* illustrates the next drop of granules by the downstream dispenser, in this case a drop of dark colored granules into the designated dark areas D of the asphalt coated substrate 101. As the leading edge of each designated dark area D moves past the downstream granule dispenser, the dispenser is commanded to begin a full drop of dark colored granules into the dark area. The result is a patch of dark colored granules 116 having a sharp leading edge 117, a field that fills the dark area D, and a scattered or indistinct trailing edge 118. However, the granules that fall into the trailing edge 118 overlap the leading edges of adjacent blend areas B, which already have been covered with blend granules. Accordingly, the dark colored granules in the indistinct trailing edges of the dark granule patches do not stick to the moving substrate 101. They just lie loosely on top of the previously deposited granules.

At this stage of the method, the entire pattern of B-L-B-D is filled in with granules except for the portions 107 that were left exposed in the blend drop of FIG. 5*a*. These exposed portions 107 are filled in as shown in FIG. 5*d* using a blend fill-in pour or flood technique. The blend granules from the pour cover the entire area of the substrate, but only stick in the exposed areas 107 since all other areas are already covered with granules. All areas are now filled in with their respective colored granules.

Finally, the substrate is directed around a clay roll, which, among other things, inverts the substrate. While inverted, the granules not stuck into the asphalt of the substrate fall away and are collected for reuse. This includes granules from the final blend pour, the light colored granules within the trailing edges of the light granule patches, and the dark colored granules within the trailing edges of the dark granule patches. The result is illustrated in FIG. 5*e*. Each granule patch, be it a blend patch, a light colored patch, or a dark colored patch is characterized by sharp liner color definition between itself and its neighbor patches. Even though individual granule drops may have exhibited indistinct and scattered trailing edges, these edges did not stick to the substrate 101 because they were dropped onto a patch of previously deposited granules in an adjacent area.

The just described technique may be implemented with the apparatus of this invention to create shingle stock with alternating color patches where the defining boarders between the patches are sharp and well defined. As described above, the apparatus itself accommodates higher line speeds than traditional granule application techniques. When combined with the just described sequencing methodology, even higher line speeds can be achieved with very good definition between different colored granule patches.

The invention has been described herein in terms of preferred embodiments and methodologies considered by the inventor to represent the best mode of carrying out the invention. It will be understood by the skilled artisan; however, that a wide range of additions, deletions, and modifications, both subtle and gross, may be made to the illustrated and exemplary embodiments without departing from the spirit and scope of the invention set forth in the claims. For example, while the pockets of the illustrated embodiment are generally rectangular for depositing rectangular patterns of granules onto an asphalt coated substrate, this is not a limitation of the invention. The pockets can, in fact, be formed with any shape that results in a corresponding desired pattern of granules on the substrate. Such custom shaped patterns of deposited granules have heretofore not been feasible with prior art techniques. The pockets may be trapezoidal in shape, for instance, to deposit wedge-shaped patterns of granules or may be star shaped to deposit granules in the pattern of a star. The possibilities are limited only by imagination.

The edges of the pockets formed by the lands need not be straight but may instead be irregularly shaped to affect the deposited patterns of granules in a desired way. The number of pockets shown in the illustrated embodiment is not a limitation and more or fewer can be provided within the scope of the invention. The pockets in the illustrated embodiment are fixed in size and equal in size. However, it is contemplated that the pockets may be adjustable in size or shape by, for example, implementation of inserts and/or they may be of different sizes and/or shapes to obtain new and previously unobtainable granule patterns on shingle products.

While the linear speed of rotation in the disclosed embodiment is fixed at some ratio of the production speed, it is within the scope of the invention that the linear speed of rotation may be varied during a granule deposit. This raises the possibility of creating unique patterns such as fading substrates along the length of the asphalt coated substrate.

While the apparatus has been described as being driven by a servo motor, a gear reducer or gear train, and an indexer, the system also can be driven by other drive mechanisms such as a servo motor and gear reducer alone and other appropriate drive mechanisms. When using a servo motor and gear reducer alone, the servo motor would be relied upon for very fast acceleration and deceleration profiles. The disclosed configuration, however, provides for improved adjustability and control. Also, in a production setting, several units as disclosed herein are used in unison to deposit patterns of granules at different locations across a substrate at different triggered times to generate the patterns desired for a particular shingle design. The particular pattern described above to illustrate one methodology of the invention (B-L-B-D . . . ) is exemplary only and many other patterns and sequencing of granule drops may be substituted with equivalent results. These and other modifications might well be made by one of skill in this art within the scope of the invention, which is delineated only by the claims.

What is claimed is:

1. A method of creating adjacent patches of different colored granules on an asphalt coated substrate moving in a downstream direction in the manufacturing of shingles, the method comprising the steps of:

defining a series of spaced apart first areas along the asphalt coated substrate designated to receive granules of a first color and defining a series of spaced apart second areas adjacent to and between the first areas designated to receive granules of a second color;

conveying the asphalt coated substrate along a production path in the downstream direction at a predetermined line speed;

incrementally rotating a first pocket wheel to move a pocket of the first pocket wheel into a supply of granules of the first color;

stopping rotation of the first pocket wheel to collect a partial charge of granules of the first color within the pocket of the first pocket wheel;

incrementally rotating the first pocket wheel to move the pocket of the first pocket wheel across a stationary seal separating the supply of granules of the first color and the moving asphalt coated substrate to cast the partial charge of granules of the first color into the first areas to create granule patches having a sharp leading edge and an indistinct trailing edge, the partial charge being less than sufficient to cover the first areas and thereby leaving a portion of the first areas exposed;

incrementally rotating a second pocket wheel to move a pocket of the second pocket wheel into a supply of granules of the second color;

stopping rotation of the second pocket wheel to collect a full charge of granules of the second color within the pocket of the second pocket wheel;

incrementally rotating the second pocket wheel to move the pocket of the second pocket wheel across a stationary seal separating the supply of granules of the second color and the moving asphalt coated substrate to cast the full charge of granules of the second color into the second areas to create granule patches having a sharp leading edge and an indistinct trailing edge, the full charge being more than sufficient to cover the second areas and thereby overlapping the leading edges of the patches of the first color;

filling the exposed portions of the first areas with granules of the first color, and removing loose granules while retaining previously applied and underlying stuck granules to create adjacent granule patches of different colors with sharp linear color definition between patches.

2. The method of claim 1 wherein the partial charge of granules of the first color are cast directly into the first areas immediately below the pocket wheel.

3. The method of claim 1 wherein the full charge of granules of the second color is cast directly into the second areas immediately below the pocket of the second pocket wheel.

4. The method of claim 1 wherein filling the exposed portions of the first areas with granules of the first color comprises passing the asphalt coated substrate through a pour of granules of the first color.

5. The method of claim 1 further comprising defining a series of spaced apart third areas along the asphalt coated substrate designated to receive granules of a third color, each of the third areas being located between two adjacent first areas.

6. The method of claim 5 further comprising:

incrementally rotating a third pocket wheel to move a pocket of the third pocket wheel into a supply of granules of the third color;

stopping rotation of the third pocket wheel to collect a full charge of granules of the third color within the pocket of the third pocket wheel; and incrementally rotating the third pocket wheel to move the pocket of the third pocket wheel across a stationary seal separating the supply of granules of the third color and the moving asphalt coated substrate to cast the full charge of granules of the third color into the third areas to create granule patches having a sharp leading edge and an indistinct trailing edge, the full charge being more than sufficient to cover the third areas and thereby overlapping the leading edges of the patches of the first color.

7. The method of claim 6 wherein the second color is lighter in color than the third color and the granules of the first color are a blend of the granules of the second color and the granules of the third color.

8. A method of creating adjacent patches of granules having alternating first and second colors along an asphalt coated substrate moving in a downstream direction at a line speed, the method comprising the steps of:

(a) rotating a first pocket wheel to move a pocket of the first pocket wheel into a supply of granules of the first color;

(b) decelerating the first pocket wheel to allow a partial charge of granules of the first color to be collected within the pocket of the first pocket wheel;

(c) accelerating the first pocket wheel to a full circumferential linear speed greater than or about ⅓ the line speed;

(d) moving the pocket of the first pocket wheel across a stationary seal separating the supply of granules of the first color and the moving asphalt coated substrate to cast the partial charge of granules of the first color directly onto the moving asphalt coated substrate immediately below the first pocket wheel to create a first patch of granules having a sharp leading edge and an indistinct trailing edge, the partial charge of granules of the first color being less than sufficient to cover an intended first area of coverage and thereby leaving an exposed portion of the intended first area of coverage upstream of the trailing edge;

(e) rotating a second pocket wheel to move a pocket of the second pocket wheel into a supply of granules of the second color;

(f) decelerating the second pocket wheel to allow a full charge of granules of the second color to be collected within the pocket of the second pocket wheel;

(g) accelerating the second pocket wheel to the full circumferential linear speed;

(h) moving the pocket of the second pocket wheel across a stationary seal separating the supply of granules of the second color and the moving asphalt coated substrate to cast the full charge of granules of the second color directly onto the moving asphalt coated substrate immediately below the second pocket wheel and downstream of the first patch of granules to create a second patch of granules having a sharp leading edge and an indistinct trailing edge, the full charge of granules of the second color being more than sufficient to cover an intended second area of coverage and thereby overlapping the leading edge of the first patch of granules;

(i) filling in the exposed portion of the intended first area of coverage with granules of the first color; and (j) in removing granules of the first color and the second color that are not embedded in the asphalt of the substrate while retaining previously applied and underlying embedded granules to create the adjacent granule patches of alternating first and second colors.

9. The method of claim 8 further comprising repeating steps (a) through (h) to create a pattern of alternating patches of granules along the asphalt coated substrate.

10. The method of claim 9 wherein the pockets of the first and second pocket wheels are generally rectangular to create patches of granules that are substantially rectangular.

11. The method of claim 8 wherein the asphalt coated substrate is moving in the downstream direction at a line speed greater than or about 800 FPM.

12. The method of claim 8 wherein the asphalt coated substrate is moving in the downstream direction at a line speed greater than or about 1,000 FPM.

13. The method of claim 1 wherein the predetermined line speed is greater than or about 1,000 FPM.

14. A method of creating adjacent patches of different colored granules on an asphalt coated substrate moving in a downstream direction in the manufacturing of shingles, the method comprising the steps of:

defining a series of spaced apart first areas along the asphalt coated substrate designated to receive granules of a first color and defining a series of spaced apart second areas adjacent to and between the first areas designated to receive granules of a second color;

conveying the asphalt coated substrate along a production path in the downstream direction at a predetermined line speed;

rotating a first pocket wheel through a supply of granules of the first color;

decelerating the first pocket wheel to allow a partial charge of granules of the first color to be collected within at least one pocket of the first pocket wheel;

accelerating the first pocket wheel to a full circumferential linear speed substantially equal to the predetermined line speed to move the pocket across a stationary seal separating the supply of granules of the first color and the moving asphalt coated substrate;

casting the granules into the first areas immediately below the first pocket wheel to create granule patches having a sharp leading edge, the partial charge being less than sufficient to cover the first areas and thereby leaving a portion of the first areas exposed;

rotating a second pocket wheel through a supply of granules of the second color;

decelerating the second pocket wheel to allow a full charge of granules of the second color to be collected within at least one pocket of the second pocket wheel;

accelerating the second pocket wheel to the full circumferential linear speed substantially equal to the predetermined line speed to move the pocket across a stationary seal separating the supply of granules of the second color and the moving asphalt coated substrate;

casting the granules into the second areas immediately below the second pocket wheel to create granule patches having a sharp leading edge and an indistinct trailing edge, the full charge being more than sufficient to cover the second areas and thereby overlapping the leading edges of the patches of the first color;

filling the exposed portions of the first areas with granules of the first color, and removing loose granules while retaining previously applied and underlying stuck granules to create adjacent granule patches of different colors with sharp linear color definition between patches.

15. The method of claim 14 wherein the asphalt coated substrate is moving in the downstream direction at a line speed greater than or about 800 FPM.

16. The method of claim 14 wherein the asphalt coated substrate is moving in the downstream direction at a line speed greater than or about 1,000 FPM.

* * * * *